US009469907B2

(12) United States Patent
Lubomirsky et al.

(10) Patent No.: US 9,469,907 B2
(45) **Date of Patent: *Oct. 18, 2016**

(54) METHODS AND APPARATUS OF ELECTROCHEMICAL PRODUCTION OF CARBON MONOXIDE, AND USES THEREOF

(71) Applicant: Yeda Research and Development Co. Ltd., Rehovot (IL)

(72) Inventors: Igor Lubomirsky, Petach Tikva (IL); Valery Kaplan, Rishon LeZion (IL)

(73) Assignee: YEDA RESEARCH AND DEVELOPMENT CO. LTD., Rehovot (IL)

( * ) Notice: Subject to any disclaimer, the term of this patent is extended or adjusted under 35 U.S.C. 154(b) by 222 days.

This patent is subject to a terminal disclaimer.

(21) Appl. No.: 14/493,111

(22) Filed: Sep. 22, 2014

(65) Prior Publication Data

US 2015/0068888 A1 Mar. 12, 2015

Related U.S. Application Data

(63) Continuation of application No. 12/941,109, filed on Nov. 8, 2010, now Pat. No. 8,906,219, which is a continuation-in-part of application No. PCT/IL2009/001042, filed on Nov. 5, 2009.

(60) Provisional application No. 61/111,754, filed on Nov. 6, 2008, provisional application No. 61/182,766, filed on Jun. 1, 2009.

(51) Int. Cl.

| | |
|---|---|
| ***C25B 13/02*** | (2006.01) |
| ***C25B 1/02*** | (2006.01) |

(Continued)

(52) U.S. Cl.

CPC . *C25B 1/02* (2013.01); *C25B 1/00* (2013.01); *C25B 11/04* (2013.01); *C25B 11/12* (2013.01); *C25B 13/02* (2013.01); *C10G 2/30* (2013.01)

(58) Field of Classification Search

CPC ..... C10G 2/30; C25B 11/04; C25B 11/12; C25B 13/02; C25B 1/00; C25B 1/02

See application file for complete search history.

(56) References Cited

U.S. PATENT DOCUMENTS

| | | | |
|---|---|---|---|
| 3,085,053 | A | 4/1963 | Taylor |
| 3,661,753 | A | 5/1972 | Aylward et al. |

(Continued)

FOREIGN PATENT DOCUMENTS

| | | |
|---|---|---|
| EP | 0 109 164 A1 | 5/1984 |
| GB | 1109143 | 4/1968 |
| WO | 2006/099573 A1 | 9/2006 |

OTHER PUBLICATIONS

Lorenz et al, Electrolysis of Molten Carbonates: Anodic and Cathodic Gas-Evolving Reactions, Electrochimica Acta, 1970, vol. 15, pp. 1025 to 1035.*

(Continued)

*Primary Examiner* — Keith Hendricks
*Assistant Examiner* — Salil Jain
(74) *Attorney, Agent, or Firm* — Kenealy Vaidya LLP

(57) ABSTRACT

The present invention relates to an electrolytic process, methods and apparatus for the preparation of carbon monoxide and in particular to electrolysis of molten carbonates to yield carbon monoxide which may be used for chemical storage of electrical energy and further as chemical feedstock for other organic products.

17 Claims, 3 Drawing Sheets

(51) Int. Cl.

| | |
|---|---|
| ***C25B 11/04*** | (2006.01) |
| ***C25B 11/12*** | (2006.01) |
| ***C25B 1/00*** | (2006.01) |
| *C10G 2/00* | (2006.01) |

(56) References Cited

U.S. PATENT DOCUMENTS

| | | | | |
|---|---|---|---|---|
| 4,086,323 | A | 4/1978 | Moore et al. | |
| 4,243,502 | A | 1/1981 | Kugler | |
| 4,937,059 | A * | 6/1990 | Kolts | B01D 53/02 423/230 |
| 5,298,342 | A * | 3/1994 | Laurens | H01M 8/0271 429/453 |
| 6,903,140 | B2 * | 6/2005 | Font Freide | C10G 2/332 518/700 |
| 8,206,856 | B2 | 6/2012 | Katano | |
| 8,906,219 | B2 * | 12/2014 | Lubomirsky | C25B 1/00 204/243.1 |
| 2008/0110765 | A1 * | 5/2008 | Ogasawara | C25B 1/26 205/402 |
| 2009/0139254 | A1 | 6/2009 | Landry | |

OTHER PUBLICATIONS

Lorenz, P. K., et al., "Electrolysis of molten carbonates: anodic and cathodic gas-evolving reactions," Electrochimica Acta, Elsevier Science Publishers, Barking, GB LINKD-DOI: 10.1016/0013-4686(70) 80042-1, vol. 15, No. 6, Jun. 1, 1970, pp. 1025-1035, XP026517467 ISSN: 0013-4686.

Berger, Carl, 1968, Handbook of Fuel Cell technology, pp. 401-406, Prentice Hall: New Jersey.

Leibhafsky, H. A. & Cairns, E. J., 1968, Fuel Cells and Fuel Batteries, pp. 289-294, John E. Wiley and Sons: New York.

The International Search Report for PCT/IL2009/001042 dated May 10, 2010.

* cited by examiner

METHODS AND APPARATUS OF ELECTROCHEMICAL PRODUCTION OF CARBON MONOXIDE, AND USES THEREOF

CROSS REFERENCE TO RELATED APPLICATIONS

This application is a Continuation of U.S. patent application Ser. No. 12/941,109, filed 8 Nov. 2010, which is a Continuation-in-Part of International Application Serial No. PCT/IL2009/001042, filed 5 Nov. 2009, which claims priority to U.S. Provisional Patent Application Ser. No. 61/111,754, filed 6 Nov. 2008, and U.S. Provisional Patent Application Ser. No. 61/182,766, filed 1 Jun. 2009, all of which are hereby incorporated by reference in their entireties.

FIELD OF THE INVENTION

The present invention relates to an electrolytic process, methods and apparatus for the preparation of carbon monoxide and in particular to electrolysis of molten carbonates to yield carbon monoxide which may be used for chemical storage of electrical energy and further as chemical feedstock for other organic products.

BACKGROUND OF THE INVENTION

Major sources of renewable energy, wind and solar, are weather- and time-dependent. Furthermore, the geographic areas best suited for harvesting these resources are remote. Therefore, chemical energy storage/transportation is viewed as the most probable way of harvesting the renewable energy.

Alternative chemical energy sources may include hydrocarbons and oxygenated aliphatics, synthesized from CO and $H_2$ via for example the Fischer-Tropsch process. More recently, the Fischer-Tropsch process has been viewed as a viable method for preparing even heavier hydrocarbons such as diesel fuels, and more preferably waxy molecules for conversion to clean, efficient lubricants. The energy and raw materials for this are currently derived from the burning of coal, with the accompanying release of $CO_2$ as a by-product. However, such process increases the $CO_2$ in the atmosphere and may lead to serious global climate. Alternatively, $CO_2$ itself may be used as a source of carbon for the production of petroleum-like materials. This may then lead to the possibility of regulating the concentration of atmospheric $CO_2$.

As $CO_2$ is one of the most thermodynamically stable carbon compounds, a highly energetic reductant or an external source of energy is required to convert it into other carbon compounds. It is well known that carbonates ($CO_3^{2-}$) can be reduced electrochemically according to the following:

$$CO_3^{2-}+2e^-\rightarrow CO+2O^{2-} \qquad \text{Cathode (1)}$$

$$2O^{-}-2e^-\rightarrow O_2 \qquad \text{Anode (2)}$$

However several side products can yield elementary carbon on the cathode or $CO_2$ on the anode:

$$\text{Cathode: } CO_3^{2-}+4e^-\rightarrow C+3O^{2-}$$

$$\text{or on the anode: } CO_3^{2-}-2e^-\rightarrow CO_2+\tfrac{1}{2}O_2$$

Furthermore the produced CO may decompose:

$$CO\leftrightarrow CO_2+C$$

Methanol is one of the major chemical raw materials, ranking third in volume behind ammonia and ethylene. Worldwide demand for methanol as a chemical raw material continues to rise especially in view of its increasingly important role (along with dimethyl ether) as a source of olefins such as ethylene and propylene and as an alternative energy source, for example, as a motor fuel additive or in the conversion of methanol to gasoline.

Methanol is not only a convenient and safe way to store energy, but, together with its derived dimethyl ether (DME), is an excellent fuel. Dimethyl ether is easily obtained from methanol by dehydration and is an effective fuel particularly in diesel engines because of its high octane number and favorable properties. Methanol and dimethyl ether can be blended with gasoline or diesel and used as fuels, for example in internal combustion engines or electricity generators. One of the most efficient uses of methanol is in fuel cells, particularly in direct methanol fuel cell (DMFC), in which methanol is directly oxidized with air to carbon dioxide and water while producing electricity.

Thus, there is a need for an efficient electrochemical method and an efficient electrochemical cell for the reduction of carbonate to carbon monoxide (CO), which further can yield chemical energy sources, such as for example, methanol. Further, the production of CO can be used for energy transportation.

SUMMARY OF THE INVENTION

In one embodiment this invention provides a method of electrochemical production of carbon monoxide comprising; heating alkaline metal carbonate salt or a mixture of alkaline and alkaline earth metal carbonate salts to form molten carbonates; electrolysis of said molten carbonate using at least two electrodes wherein a first electrode comprises titanium and a second electrode comprises graphite, titanium or combination thereof wherein a gas comprising carbon dioxide is optionally injected to said molten carbonate thereby, yielding carbon monoxide.

In one embodiment this invention provide a method for the preparation of methanol or hydrocarbons comprising: (a) heating alkaline metal carbonate salt or a mixture of alkaline and alkaline earth metal carbonate salts to form molten carbonates; electrolysis of said molten carbonate using at least two electrodes wherein a first electrode comprises titanium and a second electrode comprises graphite, titanium or combination thereof, wherein a gas comprising carbon dioxide is optionally injected to said molten carbonate thereby, yielding carbon monoxide; (b) hydrogenation of said carbon monoxide to yield methanol or hydrocarbons.

In one embodiment this invention provide an electrochemical cell for the manufacture of CO comprising:

a. a power supply;
b. a first reaction chamber comprising an alkali metal carbonate salt or a mixture of alkali metal carbonate and alkaline-earth metal carbonates;
c. a tuyere for injecting a gas comprising $CO_2$;
d. at least two electrodes, wherein a first electrode comprises titanium and a second electrode comprises graphite, titanium or combination thereof;
e. a heating system;
f. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate and are optionally located at separated compartments; and wherein by applying voltage CO is formed and conveyed via said first conduit to a gas accumulator.

In another embodiment, the electrochemical cell of this invention comprises at least two electrodes, wherein said at least two electrodes are in contact with said molten carbonate and are optionally located at separated compartments. In another embodiment, said at least two electrodes are located at the same compartment separated by a diaphragm (or membrane) of this invention.

In one embodiment this invention provide a method of the preparation of carbon monoxide, said method comprising electrolysis of molten carbonate using an electrochemical cell of this invention.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
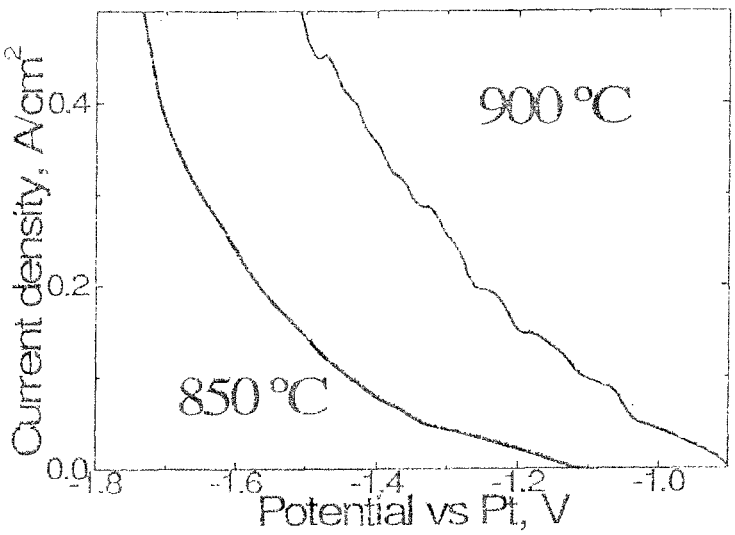
FIG. 1A depicts Quasi-static current potential dependences for Ti-cathode in molten $Li_2CO_3$.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

This invention provides, in some embodiments, methods, electrochemical cells, and apparatus for the preparation of carbon monoxide. In one embodiment, the carbon monoxide, prepared according to the methods of this invention will find application as an alternative energy source. In one embodiment, the carbon monoxide, prepared according to the methods of this invention will find application as energy transportation. In one embodiment, the carbon monoxide, prepared according to the methods of this invention will find application as chemical storage of electrical energy. In another embodiment, carbon monoxide can be used as chemical feedstock for other organic products such as plastics, polymers, hydrocarbons, carbonylation of hydrocarbons and fuel. In another embodiment, the carbon monoxide will find application as chemical feedstock for the preparation of methanol. In another embodiment the carbon monoxide will find application chemical feedstock for the preparation of hydrocarbons or oxygenated hydrocarbons.

In one embodiment this invention provides a method of electrochemical production of carbon monoxide comprising; heating alkaline metal carbonate salt or a mixture of alkaline and alkaline earth metal carbonate salts to form molten carbonates; electrolysis of said molten carbonate using at least two electrodes wherein a first electrode comprises titanium and a second electrode comprises graphite, titanium or combination thereof wherein a gas comprising carbon dioxide is optionally injected to said molten carbonate thereby, yielding carbon monoxide.

In one embodiment, this invention provides a method of electrochemical production of carbon monoxide comprising; heating alkaline metal carbonate salt to form molten carbonate; electrolysis of said molten carbonate using at least two electrodes wherein a first electrode comprises titanium and a second electrode comprises graphite wherein a gas comprising carbon dioxide is optionally injected to said molten carbonate thereby, yielding carbon monoxide.

In one embodiment, this invention provides a method of electrochemical production of carbon monoxide comprising; heating a mixture of alkaline and alkaline earth metal carbonate salts to form molten carbonates; electrolysis of said molten carbonate using at least two electrodes wherein a first electrode comprises titanium and a second electrode comprises a titanium electrode coated by carbon; wherein a gas comprising carbon dioxide is optionally injected to said molten carbonate thereby, yielding carbon monoxide.

In one embodiment, this invention provides an electrochemical cell for the manufacture of CO comprising:

a. a power supply;
b. a first reaction chamber comprising an alkaline metal carbonate salt or a mixture of alkaline metal carbonate and alkaline-earth metal carbonates;
c. a tuyere for injecting a gas comprising $CO_2$;
d. at least two electrodes, wherein a first electrode comprises titanium and a second electrode comprises graphite, titanium or combination thereof;
e. a heating system; and
f. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate and are optionally located at separated compartments; and wherein by applying voltage CO is formed and conveyed via said first conduit to a gas accumulator.

In one embodiment, this invention provides an electrochemical cell for the manufacture of CO comprising:

a. a power supply;
b. a first reaction chamber comprising an alkaline metal carbonate salt or a mixture of alkaline metal carbonate and alkaline-earth metal carbonates;
c. a tuyere for injecting a gas comprising $CO_2$;
d. at least two electrodes, wherein a first electrode comprises titanium and a second electrode comprises graphite, titanium or combination thereof;
e. a separating diaphragm between the electrodes;
f. a heating system; and
g. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate; and wherein by applying voltage CO is formed and conveyed via said first conduit to a gas accumulator.

In one embodiment, this invention provides an electrochemical cell for the manufacture of CO comprising:

a. a power supply;
b. a first reaction chamber comprising a mixture of alkaline metal carbonate and alkaline-earth metal carbonates;
c. a tuyere for injecting a gas comprising $CO_2$;
d. at least two electrodes, wherein a first electrode comprises titanium and a second electrode comprises titanium coated by carbon;
e. a heating system; and
f. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate and are optionally located at separated compartments; and wherein by applying voltage CO is formed and conveyed via said first conduit to a gas accumulator.

In one embodiment, this invention provides an electrochemical cell for the manufacture of CO comprising:

a. a power supply;
b. a first reaction chamber comprising a mixture of alkaline metal carbonate and alkaline-earth metal carbonates;
c. a tuyere for injecting a gas comprising $CO_2$;
d. at least two electrodes, wherein a first electrode comprises titanium and a second electrode comprises titanium coated by carbon;
e. a separating diaphragm between the electrodes;
f. a heating system; and
g. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate; and wherein by applying voltage CO is formed and conveyed via said first conduit to a gas accumulator.

In one embodiment this invention provide an electrochemical cell for the manufacture of CO comprising:

a. a power supply;
b. a first reaction chamber comprising an alkaline metal carbonate salt;
c. a tuyere for injecting a gas comprising $CO_2$;
d. at least two electrodes, wherein a first electrode comprises titanium and a second electrode comprises graphite;
e. a heating system; and
f. a first conduit which conveys CO from said electrochemical cell to a gas accumulator;

wherein said heating system heats said alkaline metal carbonate salt to form molten carbonate; wherein said tuyere optionally injects said gas to said molten carbonate; wherein said at least two electrodes are in contact with said molten carbonate and are optionally located at separated compartments; and wherein by applying voltage CO is formed and conveyed via said first conduit to a gas accumulator.

In one embodiment this invention provide an electrochemical cell for the manufacture of CO comprising:

a. a power supply;
b. a first reaction chamber comprising an alkaline metal-carbonate salt;
c. a tuyere for injecting a gas comprising $CO_2$;
d. at least two electrodes, wherein a first electrode comprises titanium and a second electrode comprises graphite;
e. a separating diaphragm between the electrodes;
f. a heating system; and
g. a first conduit which conveys CO from said electrochemical cell to a gas accumulator;

wherein said heating system heats said alkaline metal carbonate salt to form molten carbonate; wherein said tuyere optionally injects said gas to said molten carbonate; wherein said at least two electrodes are in contact with said molten carbonate; and wherein by applying voltage CO is formed and conveyed via said first conduit to a gas accumulator.

In one embodiment, this invention provides a method for electrochemically manufacturing carbon monoxide comprising electrolysis of molten carbonate by an electrochemical cell, wherein said electrochemical cell comprises:

a. a power supply;
b. a first reaction chamber comprising an alkaline metal carbonate salt or a mixture of alkaline metal carbonate and alkaline-earth metal carbonates;
c. a tuyere for injecting a gas comprising $CO_2$;
d. at least two electrodes, wherein a first electrode comprises titanium and a second electrode comprises graphite, titanium or combination thereof;
e. a heating system; and
f. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate and are optionally located at separated compartments; and wherein by applying voltage CO is formed and conveyed via said first conduit to a gas accumulator.

In one embodiment, this invention provides a method for electrochemically manufacturing carbon monoxide comprising electrolysis of molten carbonate by an electrochemical cell, wherein said electrochemical cell comprises:

a. a power supply;
b. a first reaction chamber comprising an alkaline metal carbonate salt or a mixture of alkaline metal carbonate and alkaline-earth metal carbonates;

c. a tuyere for injecting a gas comprising $CO_2$;

d. at least two electrodes, wherein a first electrode comprises titanium and a second electrode comprises graphite, titanium or combination thereof;

e. a separating diaphragm between the electrodes;

f. a heating system; and g. a first conduit which conveys CO from said electrochemical cell to a gas accumulator;

wherein said heating system heats said metal carbonate salt to form molten carbonate; wherein said tuyere optionally injects said gas to said molten carbonate; wherein said at least two electrodes are in contact with said molten carbonate; and wherein by applying voltage CO is formed and conveyed via said first conduit to a gas accumulator.

In one embodiment, the methods and electrochemical cells and apparatus of this invention, for the preparation of carbon monoxide comprise and/or make use of molten carbonate as an electrolyte. In another embodiment, the molten carbonate is formed by heating a carbonate salt of this invention.

A carbonate salt of this invention refers to an alkaline metal carbonate salt or to a mixture of alkaline and alkaline-earth metal carbonates.

A molten carbonate of this invention refers to molten alkaline metal carbonate salt or to a mixture of molten alkaline metal carbonate and alkaline-earth metal carbonate salt.

In one embodiment, the alkaline metal carbonate salt of this invention comprises lithium carbonate, sodium carbonate, potassium carbonate or any combination thereof. In another embodiment, the alkaline metal carbonate salt is lithium carbonate ($Li_2CO_3$). In another embodiment, the alkaline metal carbonate salt is sodium carbonate ($Na_2CO_3$). In another embodiment, the alkaline metal carbonate salt is potassium carbonate ($K_2CO_3$). In another embodiment, the alkaline metal carbonate salt comprises at least 50% lithium carbonate ($Li_2CO_3$).

In one embodiment the alkaline-earth metal carbonate salt of this invention comprises barium carbonate, strontium carbonate, calcium carbonate or any combination thereof. In another embodiment the alkaline-earth metal carbonate salt is barium carbonate. In another embodiment the alkaline-earth metal carbonate salt is strontium carbonate. In another embodiment the alkaline-earth metal carbonate salt is calcium carbonate.

In another embodiment the mixture of alkaline and alkaline-earth metal carbonates is in a ratio of between 1:1 molar ratio to 0.95:0.05 molar ratio respectively. In another embodiment the mixture of alkaline and alkaline-earth metal carbonates is in a ratio of between 1:1 molar ratio. In another embodiment, the mixture of alkaline and alkaline-earth metal carbonates is in a ratio of between 0.6:0.4 molar ratio; In another embodiment, the mixture of alkaline and alkaline-earth metal carbonates is in a ratio of between 0.7:0.3 molar ratio; In another embodiment, the mixture of alkaline and alkaline-earth metal carbonates is in a ratio of between 0.8:0.2 molar ratio; In another embodiment, the mixture of alkaline and alkaline-earth metal carbonates is in a ratio of between 0.9:0.1 molar ratio.

In one embodiment, the methods, electrochemical cells and apparatus of this invention comprise and/or make use of molten carbonates for the preparation of carbon monoxide. In another embodiment, molten carbonate is formed by heating carbonate salt of this invention to its melting point. In another embodiment, a molten $Li_2CO_3$ is formed by heating $Li_2CO_3$ to a temperature of above 723° C. In another embodiment, a molten $Li_2CO_3$ is prepared by any known process known in the art.

In one embodiment, the methods, electrochemical cells and apparatus of this invention comprise and/or make use of molten carbonates as an electrolyte for the preparation of carbon monoxide. In another embodiment, the electrolyte of this invention is $Li_2CO_3$. In another embodiment, the electrolyte of this invention comprises at least 50% $Li_2CO_3$. In another embodiment, the lithium ion is stable and is not reduced at high temperatures of between 780-900° C. In another embodiment, the lithium ions do not stabilize formation of peroxides and peroxi-carbonate ions. In another embodiment, it was found that the weight loss after the heating for 2 hrs at 900° C. was 1.2% (w/w) and it the weight did not increase after heating for 24 h at 900° C. according to Example 2.

During the electrolysis process of molten carbonate of this invention to yield carbon monoxide, the concentration of the carbonate ions decreases. In another embodiment, during the electrolysis process of molten carbonate of this invention to yield carbon monoxide, the metal carbonate is oxidized and metal oxide is formed. In another embodiment, a metal oxide in the presence of carbon dioxide form a metal carbonate. In another embodiment, during the electrolysis process of molten lithium carbonate to yield carbon monoxide, lithium oxide ($Li_2O$) is formed. In another embodiment, lithium oxide ($Li_2O$) in the presence of carbon dioxide form lithium carbonate ($Li_2CO_3$). In one embodiment, a gas comprising carbon dioxide is added to the electrochemical cell in order to maintain constant concentration of the carbonate ions. In another embodiment, the metal oxide reacts with the carbon dioxide to yield metal carbonate.

During the electrolysis process of molten carbonate to yield carbon monoxide, wherein the molten carbonate is a mixture of alkaline and alkaline earth metal carbonate salt, metal oxide layer is formed on the surface of the molten carbonate.

In another embodiment metal oxide crystals are formed on the surface of the molten carbonate. In another embodiment, the metal oxide crystals or layer in the presence of atmospheric $CO_2$, spontaneously yield metal carbonate wherein said metal carbonate is reused in the electrolysis process, electrochemical cell or apparatus of this invention.

During the electrolysis process of molten carbonate, wherein the molten carbonate is a mixture of alkaline and alkaline earth metal carbonate salt, metal oxide layer or crystals are formed on the surface of the molten carbonate. In one embodiment, the metal oxide layer or crystals on the surface of the molten carbonate is removed and recycled together with $CO_2$ to yield a metal carbonate. In another embodiment, the recycled metal carbonate can be used again in the electrolysis process, electrochemical cells and/or apparatus of this invention.

In one embodiment, a metal oxide in the presence of carbon dioxide yield a metal carbonate. In one embodiment, the gas comprising $CO_2$ which reacts with the metal oxide of this invention is pure or concentrated $CO_2$. In another embodiment, the $CO_2$ which reacts with the metal oxide is atmospheric $CO_2$. In another embodiment, $CO_2$ is injected continuously to the electrochemical cell during the electrolysis. In another embodiment, $CO_2$ is diffused from air to the electrochemical cell.

In another embodiment, the gas comprising carbon dioxide comprises between 0.01-100% carbon dioxide by weight of gas. In another embodiment, the gas comprising carbon dioxide comprises between 0.03-98% carbon dioxide by weight of gas. In another embodiment, the gas comprising carbon dioxide comprises between 50-100% carbon dioxide by weight of gas. In another embodiment, the gas comprising carbon dioxide comprises between 80-100% carbon dioxide by weight of gas. In another embodiment, the gas comprising carbon dioxide comprises between 0.1-5% carbon dioxide by weight of gas. In another embodiment, the gas comprising carbon dioxide comprises between 0.01-5% carbon dioxide by weight of gas.

In one embodiment, the methods, electrochemical cells and apparatus of this invention for the preparation of carbon monoxide comprise and/or make use of at least two electrodes. In one embodiment a first electrode is a cathode. In another embodiment, the cathode or first electrode comprise a valve metal. In another embodiment, the cathode or first electrode comprises titanium. In another embodiment, the cathode or first electrode is a titanium electrode. In another embodiment, the cathode or first electrode is an alloy comprising titanium. In another embodiment, the cathode or first electrode is a titanium alloy comprising titanium, aluminium, zirconium, tantalum, niobium or any combination thereof.

The term "valve metal" refers to a metal which, when oxidizes allows current to pass if used as a cathode but opposes the flow of current when used as an anode. Non limiting examples of valve metals include magnesium, thorium, cadmium, tungsten, tin, iron, silver, silicon, tantalum, titanium, aluminum, zirconium and niobium. In another embodiment, valve metals are covered by a protective layer of oxide and, therefore, should not promote decomposition of the produced CO according to the Boudouard reaction $CO \leftrightarrow CO_2+C$. In another embodiment, the oxide layers formed on the surface of the valve metals often protect them from the aggressive melts.

In another embodiment the titanium electrode does not corrode in molten $Li_2CO_3$ since it forms a protective layer of $Li_2TiO_3$ which above 750° C., this layer is conductive and does not contribute significantly to the cell resistance. In another embodiment, lithium metal is insoluble in titanium, which excludes alloying during the electrolysis.

In one embodiment, the methods, electrochemical cells and apparatus for the preparation of carbon monoxide of this invention comprise and/or make use of a titanium electrode. In another embodiment, the titanium electrode of this invention is prepared from 5 mm thick Ti-plates. In another embodiment, the titanium electrode is stable for prolong exposure to molten carbonate. In another embodiment, prolonged exposure of about 100 h of the titanium electrode to lithium carbonate indicated that the concentration of titanium in the electrolyte is below 0.02 mole % (traces) and does not rise upon further exposure. In another embodiment, the titanium electrode is stable for prolonged exposure to the electrolyte, as exemplified in Example 3.

In one embodiment, the methods, electrochemical cells and apparatus of this invention comprise and/or make use of at least two electrodes. In another embodiment a second electrode is an anode. In another embodiment, the anode or second electrode comprises titanium, graphite or combination thereof. In another embodiment, the anode or second electrode comprises carbon. In another embodiment, the anode or second electrode is a graphite electrode. In another embodiment, the anode or second electrode is pressed graphite or glassy graphite. In another embodiment, the pressed chemically pure graphite does not corrode in the molten $Li_2CO_3$. No weight loss to the graphite electrode was detected after 100 h of electrolysis (100 mA/cm$^2$ at 900° C.) and exposure to the electrolyte without current. In another embodiment the stability of the graphite electrode is described in Example 3.

In another embodiment, the anode or second electrode is a titanium electrode. In another embodiment, the anode or second electrode is a titanium alloy. In another embodiment, the anode or second electrode is a titanium alloy comprising titanium, aluminium, zirconium, tantalum, niobium or any combination thereof. In another embodiment, the anode or second electrode is a titanium electrode coated by carbon/graphite.

The methods, electrochemical cells and apparatus of this invention for the preparation of carbon monoxide comprise and/or make use of an anode. In one embodiment, the anode is a titanium or titanium alloy electrode coated by carbon/graphite. In one embodiment the titanium electrode coated by graphite is prepared by aging a titanium electrode or titanium alloy electrode dipped in molten carbonate under negative potential greater than 3 volts at a temperature of between 700-900 deg C. for between 10-60 min, thereby coating said titanium electrode by carbon. In another embodiment, such an electrode is used as an anode upon applying a positive potential. In another embodiment, the process for preparing a titanium electrode coated by carbon is as described in Example 4.

In another embodiment, the negative potential used for the preparation of the titanium or titanium alloy electrode coated by carbon/graphite is between 3-5 volts. In another embodiment the negative potential is between 3-6 volts. In another embodiment the negative potential is between 3-7 volts.

In another embodiment, the temperature used for the preparation of the titanium or titanium alloy electrode coated by carbon/graphite is between 700-900 deg C. for between 10-60 min. In another embodiment, the temperature is between 750-850 deg C. In another embodiment, the temperature is between 750-900 deg C. In another embodiment, the aging step is 20 min. In another embodiment, the aging step is between 10-50 min. In another embodiment, the aging step is between 15-60 min. In another embodiment, the aging step is between 30-60 min. In another embodiment, the aging step is between 10-20 min.

In one embodiment, the methods, electrochemical cells and apparatus of this invention for the preparation of carbon monoxide comprise and/or make use of at least two electrodes, wherein the first electrode is a cathode; the second electrode is an anode and a third electrode is optionally a reference electrode. In another embodiment, the reference electrode is a Pt wire.

An ideal reference electrode has a stable, well-defined electrochemical potential. Common reference electrodes include calomel: mercury/mercury chloride; silver/silver chloride or copper/copper sulfate meet this criterion when they are functioning proper and should also have zero impedance.

The purpose of a reference electrode in potentiometry is to provide a steady potential against which to measure the working electrode half-cell (for example, an ion-selective electrode, redox potential electrode or enzyme electrode).

In one embodiment, the methods, electrochemical cells and apparatus of this invention make use of at least two electrodes. In another embodiment, said at least two electrodes are optionally located at separated compartments. In another embodiment, said at least two electrodes are located at the same compartment and separated by a diaphragm.

In another embodiment, a diaphragm of this invention refers to a membrane.

Figure 3:
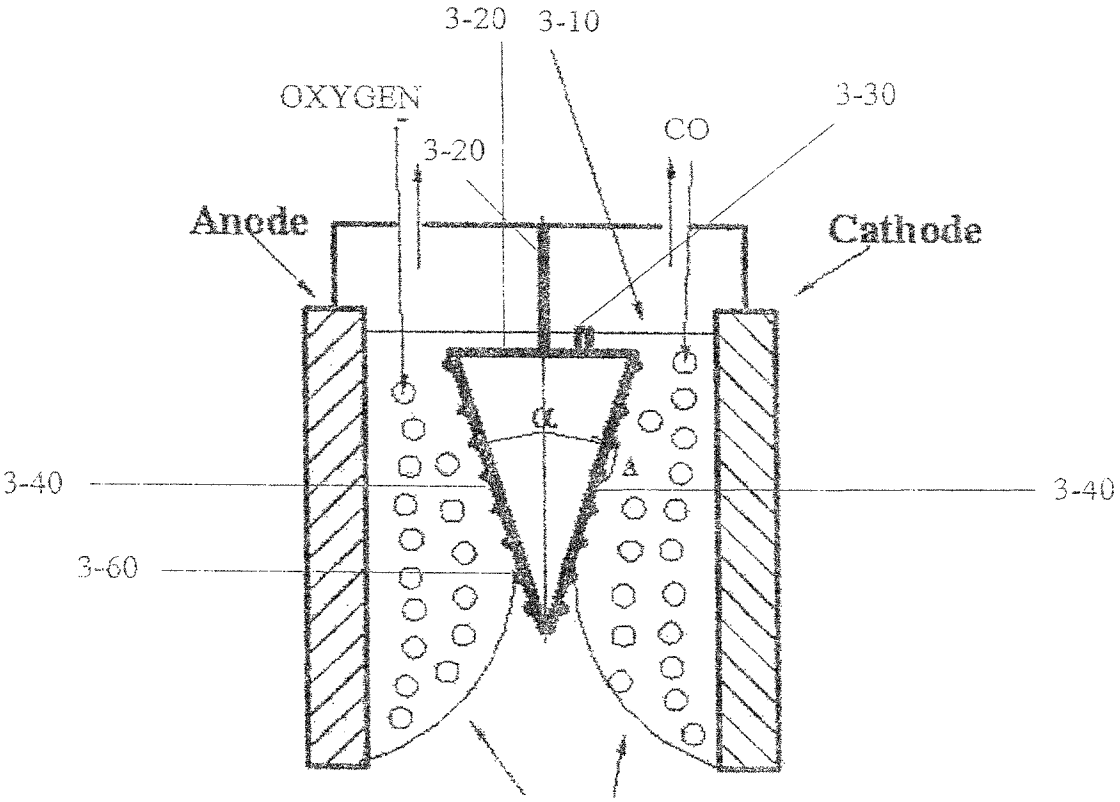
FIG. 3 depicts a separating diaphragm (or membrane), located between the two electrodes of the electrochemical cell of this invention. The diaphragm includes a metal plate (3-20) which is attached to two metal grids (3-40). The metal plate (3-20) is partly located below the level of the melt (3-10). Angle α—between two separate parts of the metal grid (3-40); A—range between the centers of the pores (3-70) of the metal grid. The diaphragm has an outlet (3-30) allowing gas trapped in the interior of the diaphragm to be released to the atmosphere. (Just if gas succeeded to diffuse through the grid). The gas which is formed during the electrolysis tends to go up to the atmosphere, therefore a border zone is formed (3-50) where there is no mix of gases. The border zone is not part of the diaphragm—just a zone that is formed in the cell.

In one embodiment, the electrochemical cells and/or apparatus of this invention comprise a separating diaphragm (or membrane) separating the gases formed during the electrolysis of this invention. In another embodiment, the gas formed during the electrolysis of the molten carbonate is CO and $O_2$. In another embodiment, the diaphragm of this invention can be used in any electrochemical cell for separating any gaseous products, wherein gas is formed during the electrolysis. In one embodiment this invention is directed to a diaphragm or a membrane for separating gaseous products formed during an electrolysis. In another embodiment, the diaphragm of this invention comprises a metal plate which is attached to two metal grids. Angle α—between two separate parts of the metal grid; A—range between the centers of the pores of the metal grid. The diaphragm has an outlet allowing gas trapped in the interior of the diaphragm to be released to the atmosphere. (Just if gas succeeded to diffuse through the grid). The gas which is formed during the electrolysis tends to go up to the atmosphere, therefore a border zone is formed where there is no mix of gases. The border zone is not part of the diaphragm—just a zone that is formed in the cell. In another embodiment, the diaphragm of this invention is as depicted in FIG. 3.

In one embodiment, the diaphragm of this invention includes two units. In another embodiment the two units include a metal plate and a metal grid.

In one embodiment, the metal plate of the separating diaphragm of this invention, is positioned between the anode and the cathode of the electrochemical cell, wherein part of the metal plate is dipped into a melt. In another embodiment, the metal plate is dipped in about 10-100 mm into the melt.

In one embodiment, the metal grids of the separating diaphragm of this invention, is positioned between the anode and the cathode of the electrochemical cell, wherein all the metal grid is dipped into a melt. In another embodiment, the metal grid is dipped in the melt at a height which is 40-90% of the total height of the electrodes of the invention. In another embodiment, the electrochemical cell with a diaphragm is depicted in FIG. 3.

In another embodiment, the pores of the metal grid (depicted as 3-40 in FIG. 3) have a diameter of between 0.5-5.0 mm. In another embodiment, the pores of the metal grid of the separating diaphragm have a diameter of between 0.5-1.0 mm. In another embodiment, the pores of the metal grid of the separating diaphragm have a diameter of between 1.0-2.0 mm. In another embodiment, the pores of the metal grid of the separating diaphragm have a diameter of between 2.0-3.0 mm. In another embodiment, the pores of the metal grid of the separating diaphragm have a diameter of between 3.0-4.0 mm. In another embodiment, the pores of the metal grid of the separating diaphragm have a diameter of between 4.0-5.0 mm. In another embodiment, the pores of the metal grid of the separating diaphragm have a diameter of between 2.0-5.0 mm.

In one embodiment, the pores (or windows) of the metal grid are up slope directed on the metal grid of the diaphragm of this invention. In another embodiment, the metal grid has an up-slope pores as depicted in FIG. 3. In another embodiment, the metal grid consists of two units which are connected to each other at an angle alpha (α). In another embodiment, the angle "α" (FIG. 3) between the said two separate units is zero (0) degree (i.e the grids are parallel). In another embodiment, the angle "α" (FIG. 3) between the said two separate units is between 0.1-45 degrees. In another embodiment, the distance "A" (FIG. 3) between the centers of the up-slope direction windows is within 20-200 mm. In another embodiment, the distance "A" (FIG. 3) between the centers of the up-slope direction pores (or windows) is within 20-50 mm. In another embodiment, the distance "A" (FIG. 3) between the centers of the up-slope direction windows is within 50-100 mm. In another embodiment, the distance "A" (FIG. 3) between the centers of the up-slope direction windows is within 100-200 mm. In another embodiment, the distance "A" (FIG. 3) between the centers of the up-slope direction windows is within 50-150 mm.

In one embodiment, the electrochemical cells of this invention, apparatus of this invention or any electrochemical cell for gaseous products and/or gas separation comprise a separating diaphragm separating the gas formed during the electrolysis. In another embodiment, the separating diaphragm is positioned between the anode and the cathode of the electrochemical.

In another embodiment, the separating diaphragm is positioned in the middle between the anode and the cathode. In another embodiment, the separating diaphragm is positioned closer to the cathode. In another embodiment, the separating diaphragm is positioned closer to the anode. In another embodiment, the diaphragm is located at a position between the anode and the cathode.

In one embodiment, the electrochemical cells of this invention, apparatus of this invention or any electrochemical cell for gaseous products and/or gas separation comprise a separating diaphragm separating the gas formed during the electrolysis. In another embodiment, the diaphragm is manufactured from titanium or a titanium alloy. In another embodiment, the titanium alloy comprises titanium, aluminium, zirconium, tantalum, niobium or any combination thereof.

In one embodiment, the diaphragm of this invention, for separating gaseous products, is used in any electrochemical cell, wherein gas is formed during the electrolysis.

In another embodiment, the diaphragm is located between the anode and the cathode. In another embodiment, the diaphragm is dipped in a molten material (or melt). In another embodiment, the melt comprises metal salts of carbonates, chlorides, fluorides, sulphides, oxides or any combination thereof. In another embodiment, the metal comprises alkali salts and/or alkaline-earth salts.

In another embodiment, the diaphragm of this invention separates the gas formed during an electrolysis process. The gas which is formed aggregates and do not diffuse through the grids of diaphragm having pores diameter size of between 0.5-5.0 mm. In another embodiment, if gas diffuses through the grid, it may be released via an outlet. In another embodiment, an outlet of the diaphragm is depicted as 3-30 in FIG. 3.

In another embodiment, a gas which is formed during the electrolysis aggregates and diffuses out of the melt. In another embodiment, the CO and $O_2$ which is formed in the electrochemical cell of this invention do not mix at the lower part of the cell, as they diffuse up, out of the melt, therefore a border zone of gas bubbles is formed (depicted as 3-50 in FIG. 3), wherein the CO and $O_2$ do not mix.

In one embodiment, the methods of this invention are conducted under inert gas. In another embodiment, the methods of this invention are conducted in the presence of atmospheric air. In one embodiment, the methods of this invention are conducted under atmospheric pressure. In one embodiment, the methods of this invention are conducted under pressurized conditions. In one embodiment, the methods of this invention are conducted at high temperature conditions.

In one embodiment, the methods, electrochemical cells and apparatus of this invention for the preparation of carbon monoxide comprise and/or make use of a heating system, wherein the electrolysis of the alkali carbonate salt is conducted under heating. In another embodiment, the heating system is a furnace. In another embodiment, the electrolysis is conducted at a temperature of between 780-950° C. In another embodiment, the electrolysis is conducted at a temperature of between 800-900° C. In another embodiment, the electrolysis is conducted at a temperature of between 850-900° C. In another embodiment, the electrolysis is conducted at a temperature of between 850-950° C.

In one embodiment, the methods, electrochemical cells and apparatus of this invention for the preparation of carbon monoxide comprise heating the alkaline and/or alkaline metal carbonate salt to form metal carbonate. In another embodiment, the heating is at a temperature of between 780-950° C. In another embodiment, the heating is at a temperature of between 800-900° C. In another embodiment, the heating at a temperature of between 850-900° C. In another embodiment, the heating is at a temperature of between 850-950° C.

In one embodiment, the methods and electrochemical cells of this invention for the preparation of carbon monoxide includes electrolysis of carbonate ions. In another embodiment, a potential of between 0.9 to 1.2 V is applied. In another embodiment, a potential of between 1.1±0.05 V is applied. In another embodiment, a potential of between 1.1 to 1.2 V is applied. In another embodiment, a potential of between 1.0 to 1.1 V is applied.

In one embodiment, the electrolysis of molten carbonates of this invention has a Faradaic efficiency of 100% and a thermodynamic efficiency of between 80-100%. In another embodiment, the thermodynamic efficiency is between 80-90%. In another embodiment, the thermodynamic efficiency is about 85±4%.

The term "Faradaic efficiency" refers to the energy efficiency with which a species is electrolyzed at a given charge, can be accomplished. High Faradaic efficiencies suggest that the process requires lower energy to complete the reaction making the process more feasible.

The term "thermodynamic efficiency" refers to the maximum efficiency of electrochemical cell. Thermodynamic efficiency refers to the ratio of the amount of work done by a system to the amount of heat generated by doing that work. Thermodynamic Efficiency:

$$\varepsilon_T = \frac{\Delta G}{\Delta H}$$

where ΔH is the enthalpy of the reaction and ΔG is the change in the Gibbs energy of combustion of CO: ($CO+\frac{1}{2}O_2 \leftrightarrow CO_2$). In another embodiment the Gibbs energy of combustion of CO at 900° C. is ΔG=181 kJ/mol.

In one embodiment, this invention provides an electrochemical cell which is thermal stable. In another embodiment, the electrochemical cell comprises a first reaction chamber. In another embodiment, the frame of the first reaction chamber is made from titanium or titanium alloys. In another embodiment, the titanium alloy comprises titanium, aluminium, zirconium, tantalum, niobium or any combination thereof. In another embodiment, the electrochemical cell an/or the frame of the first reaction chamber is made from high purity alumina, GeO, ceramics comprising yttrium oxide, beryllium oxide, lithium beryllium alloys or lithium yttrium alloys.

In one embodiment, this invention provides methods, electrochemical cells and apparatus for the preparation of carbon monoxide. In another embodiment, the carbon monoxide is collected from the cathode compartment into a gas accumulator. In another embodiment the gas accumulator is a container, vessel, flask, porous material, or any combination thereof.

In one embodiment this invention provide a method for the preparation of methanol or hydrocarbons comprising: (a) heating alkaline metal carbonate salt or a mixture of alkaline and alkaline earth metal carbonate salts to form molten carbonates; electrolysis of said molten carbonate using at least two electrodes wherein a first electrode comprises titanium and a second electrode comprises graphite, titanium or combination thereof, wherein a gas comprising carbon dioxide is optionally injected to said molten carbonate thereby, yielding carbon monoxide.

In one embodiment, this invention provides a method for the preparation of methanol or hydrocarbons comprising: (a) heating alkali carbonate salt to form molten carbonate; electrolysis of said molten carbonate using at least two electrodes wherein a first electrode comprises titanium and a second electrode comprises graphite wherein a gas comprising carbon dioxide is optionally injected to said molten carbonate thereby, yielding carbon monoxide; (b) hydrogenation of said carbon monoxide to yield methanol or hydrocarbons.

In one embodiment, this invention provides a method for the preparation of methanol or hydrocarbons comprising: (a) heating a mixture of alkaline and alkaline earth metal carbonate salts to form molten carbonates; electrolysis of said molten carbonate using at least two electrodes wherein a first electrode comprises titanium and a second electrode comprises titanium coated by graphite/carbon wherein a gas comprising carbon dioxide is optionally injected to said molten carbonate thereby, yielding carbon monoxide; (b) hydrogenation of said carbon monoxide to yield methanol or hydrocarbons.

In one embodiment this invention provide an apparatus for the manufacture of methanol or carbohydrates comprising:

(i) an electrochemical cell comprising:
  a. a power supply;
  b. a first reaction chamber comprising an alkali metal carbonate salt or a mixture of alkali metal carbonate and alkaline-earth metal carbonates salts;
  c. a tuyere for injecting a gas comprising $CO_2$;
  d. at least two electrodes, wherein a first electrode comprises titanium and a second electrode comprises graphite, titanium or combination thereof; and
  e. a heating system;
    wherein said heating system heats said metal carbonate salt to form molten carbonate; wherein said tuyere optionally injects said gas to said molten carbonate; and said at least two electrodes are in contact with said molten carbonate and are optionally located at separated compartments;

(ii) a second reaction chamber an inlet for introduction of $H_2$ into said second reaction chamber;

(iii) a first conduit which conveys CO from said electrochemical cell into said second chamber; and (iv) a second conduit which conveys methanol or hydrocarbons from said second reaction chamber to an outlet;

wherein by applying voltage CO is formed and conveyed via said first conduit to said second reaction chamber; and wherein said CO and $H_2$ react in said second reaction chamber to yield said methanol or hydrocarbons.

In one embodiment this invention provide an apparatus for the manufacture of methanol or carbohydrates comprising:

(i) an electrochemical cell comprising:

a. a power supply;

b. a first reaction chamber comprising an alkali metal carbonate salt or a mixture of alkali metal carbonate and alkaline-earth metal carbonates salts;

c. a tuyere for injecting a gas comprising $CO_2$;

d. at least two electrodes, wherein a first electrode comprises titanium and a second electrode comprises graphite, titanium or combination thereof;

e. a separating diaphragm between said at least two electrodes; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments;

(ii) a second reaction chamber an inlet for introduction of $H_2$ into said second reaction chamber;

(iii) a first conduit which conveys CO from said electrochemical cell into said second chamber; and (iv) a second conduit which conveys methanol or hydrocarbons from said second reaction chamber to an outlet;

wherein by applying voltage CO is formed and conveyed via said first conduit to said second reaction chamber; and wherein said CO and $H_2$ react in said second reaction chamber to yield said methanol or hydrocarbons.

In one embodiment this invention provide an apparatus for the manufacture of methanol or hydrocarbons comprising:

(i) a first electrochemical cell comprising:

a. a power supply;

b. a first reaction chamber comprising an alkali metal carbonate salt or a mixture of alkali metal carbonate and alkaline-earth metal carbonates salt;

c. a tuyere for injecting a gas comprising $CO_2$;

d. at least two electrodes, wherein a first electrode comprises titanium and a second electrode comprises graphite, titanium or combination thereof; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments; wherein by applying voltage CO is formed;

(ii) a second electrochemical cell comprising;

a. power supply;

b. a third reaction chamber; and c. at least two electrodes;

wherein by applying voltage $H_2$ is formed;

(iii) a second reaction chamber;

(iv) a first conduit which conveys CO from said first electrochemical cell to said second chamber;

(v) a third conduit which conveys $H_2$ from said second electrochemical cell to said second reaction chamber; and (vi) a second conduit which conveys methanol or hydrocarbons from said second reaction chamber to an outlet;

wherein said CO is conveyed via said first conduit to said second reaction chamber; said $H_2$ is conveyed via said third conduit to said second reaction chamber; and said CO and $H_2$ react in said second reaction chamber to yield methanol or hydrocarbons.

In one embodiment this invention provide an apparatus for the manufacture of methanol or hydrocarbons comprising:

(i) a first electrochemical cell comprising:

a. a power supply;

b. a first reaction chamber comprising an alkali metal carbonate salt or a mixture of alkali metal carbonate and alkaline-earth metal carbonates salt;

c. a tuyere for injecting a gas comprising $CO_2$;

d. at least two electrodes, wherein a first electrode comprises titanium and a second electrode comprises graphite, titanium or combination thereof;

e. a separating diaphragm between said at least two electrodes; and f. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments; wherein by applying voltage CO is formed;

(ii) a second electrochemical cell comprising;

a. power supply;

b. a third reaction chamber; and c. at least two electrodes;

wherein by applying voltage $H_2$ is formed;

(iii) a second reaction chamber;

(iv) a first conduit which conveys CO from said first electrochemical cell to said second chamber;

(v) a third conduit which conveys $H_2$ from said second electrochemical cell to said second reaction chamber; and (vi) a second conduit which conveys methanol or hydrocarbons from said second reaction chamber to an outlet;

wherein said CO is conveyed via said first conduit to said second reaction chamber; said $H_2$ is conveyed via said third conduit to said second reaction chamber; and said CO and $H_2$ react in said second reaction chamber to yield methanol or hydrocarbons.

In one embodiment, this invention provides a method for the preparation of methanol or hydrocarbons, said method comprising reacting carbon monoxide and hydrogen using an apparatus, said apparatus comprises:

(i) an electrochemical cell comprising:

a. a power supply;

b. a first reaction chamber comprising an alkali metal carbonate salt or a mixture of alkali metal carbonate and alkaline-earth metal carbonates salts;

c. a tuyere for injecting a gas comprising $CO_2$;

d. at least two electrodes, wherein a first electrode comprises titanium and a second electrode comprises graphite, titanium or combination thereof; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments;

(ii) a second reaction chamber an inlet for introduction of $H_2$ into said second reaction chamber;

(iii) a first conduit which conveys CO from said electrochemical cell into said second chamber; and (iv) a second conduit which conveys methanol or hydrocarbons from said second reaction chamber to an outlet;

wherein by applying voltage CO is formed and conveyed via said first conduit to said second reaction chamber; and wherein said CO and $H_2$ react in said second reaction chamber to yield said methanol or hydrocarbons.

In one embodiment, this invention provides a method for the preparation of methanol or hydrocarbons, said method comprising reacting carbon monoxide and hydrogen using an apparatus, said apparatus comprises:

(i) an electrochemical cell comprising:

a. a power supply;

b. a first reaction chamber comprising an alkali metal carbonate salt or a mixture of alkali metal carbonate and alkaline-earth metal carbonates salts;

c. a tuyere for injecting a gas comprising $CO_2$;

d. at least two electrodes, wherein a first electrode comprises titanium and a second electrode comprises graphite, titanium or combination thereof;

e. a separating diaphragm between said at least two electrodes; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments;

(ii) a second reaction chamber an inlet for introduction of $H_2$ into said second reaction chamber;

(iii) a first conduit which conveys CO from said electrochemical cell into said second chamber; and (iv) a second conduit which conveys methanol or hydrocarbons from said second reaction chamber to an outlet;

wherein by applying voltage CO is formed and conveyed via said first conduit to said second reaction chamber; and wherein said CO and $H_2$ react in said second reaction chamber to yield said methanol or hydrocarbons.

In one embodiment, this invention provides a method for the preparation of methanol or hydrocarbons, said method comprising reacting carbon monoxide and hydrogen using an apparatus, said apparatus comprises:

(i) a first electrochemical cell comprising:

a. a power supply;

b. a first reaction chamber comprising an alkali metal carbonate salt or a mixture of alkali metal carbonate and alkaline-earth metal carbonates salt;

c. a tuyere for injecting a gas comprising $CO_2$;

d. at least two electrodes, wherein a first electrode comprises titanium and a second electrode comprises graphite, titanium or combination thereof; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments; wherein by applying voltage CO is formed;

(ii) a second electrochemical cell comprising;

a. power supply;

b. a third reaction chamber; and c. at least two electrodes;

wherein by applying voltage $H_2$ is formed;

(iii) a second reaction chamber;

(iv) a first conduit which conveys CO from said first electrochemical cell to said second chamber;

(v) a third conduit which conveys $H_2$ from said second electrochemical cell to said second reaction chamber; and (vi) a second conduit which conveys methanol or hydrocarbons from said second reaction chamber to an outlet;

wherein said CO is conveyed via said first conduit to said second reaction chamber; said $H_2$ is conveyed via said third conduit to said second reaction chamber; and said CO and $H_2$ react in said second reaction chamber to yield methanol or hydrocarbons.

In one embodiment, this invention provides a method for the preparation of methanol or hydrocarbons, said method comprising reacting carbon monoxide and hydrogen using an apparatus, said apparatus comprises:

(i) a first electrochemical cell comprising:

a. a power supply;

b. a first reaction chamber comprising an alkali metal carbonate salt or a mixture of alkali metal carbonate and alkaline-earth metal carbonates salt;

c. a tuyere for injecting a gas comprising $CO_2$;

d. at least two electrodes, wherein a first electrode comprises titanium and a second electrode comprises graphite, titanium or combination thereof;

f. a separating diaphragm between said at least two electrodes; and e. a heating system;

wherein said heating system heats said metal carbonate salt to form molten carbonate; wherein said tuyere optionally injects said gas to said molten carbonate; and said at least two electrodes are in contact with said molten carbonate and are optionally located at separated compartments; wherein by applying voltage CO is formed;

(ii) a second electrochemical cell comprising;

a. power supply;

b. a third reaction chamber; and c. at least two electrodes;

wherein by applying voltage $H_2$ is formed;

(iii) a second reaction chamber;

(iv) a first conduit which conveys CO from said first electrochemical cell to said second chamber;

(v) a third conduit which conveys $H_2$ from said second electrochemical cell to said second reaction chamber; and (vi) a second conduit which conveys methanol or hydrocarbons from said second reaction chamber to an outlet;

wherein said CO is conveyed via said first conduit to said second reaction chamber; said $H_2$ is conveyed via said third conduit to said second reaction chamber; and said CO and $H_2$ react in said second reaction chamber to yield methanol or hydrocarbons.

In one embodiment, this invention provides methods, electrochemical cells and apparatus for the preparation of methanol or hydrocarbons where a first reaction chamber comprising alkaline metal carbonate salt or a mixture of alkaline metal carbonate salt and alkaline-earth metal carbonate salt. In another embodiment, the first reaction chamber comprises alkaline metal carbonate salt. In another embodiment, the first reaction chamber comprises a mixture of alkaline metal carbonate salt and alkaline-earth metal carbonate salt.

In one embodiment, this invention provides methods, electrochemical cells and apparatus for the preparation of methanol or hydrocarbons comprising at least two electrodes, wherein a first electrode comprises titanium and a second electrode comprises graphite, titanium or combination thereof. In another embodiment, the second electrode is a graphite electrode. In another embodiment, the second electrode is a titanium electrode. In another embodiment, the second electrode is a titanium electrode coated by graphite/carbon.

In one embodiment, this invention provides methods, electrochemical cells and apparatus for the preparation of methanol or hydrocarbons where carbon monoxide in formed in the cathode compartment of the first reaction chamber and is conveyed to a second reaction chamber where the hydrogenation of the carbon monoxide is conducted to yield methanol and/or hydrocarbons.

In another embodiment, the hydrogenation of carbon monoxide is conducted in the presence of a catalyst. In another embodiment, the hydrogenation of the carbon monoxide is conducted under pressurized conditions. In another embodiment, the hydrogenation is conducted under high temperature conditions.

In one embodiment, this invention provides methods, electrochemical cells and apparatus for the preparation of methanol or hydrocarbons where carbon monoxide and hydrogen are reacted. In another embodiment, hydrogen is being pumped into the second reaction chamber. In another embodiment, hydrogen is produced by electrolysis of water. In another embodiment, hydrogen is being produced by electrolysis of water in a second electrolysis cell and being conveyed to the second reaction chamber of the apparatus of this invention.

In one embodiment, hydrocarbons are prepared by hydrogenation of carbon monoxide according to Fischer Tropsch process. In another embodiment, methanol is prepared by hydrogenation of carbon monoxide in the presence of heterogeneous catalyst. In another embodiment, the heterogeneous catalyst is copper/zinc catalyst.

Both methanol (as well as dimethyl ether) and Fischer-Tropsch liquids can be produced via the catalytic conversion of a gaseous feedstock comprising hydrogen, carbon monoxide dioxide. Such a gaseous mixture is commonly referred to as synthesis gas or "syngas".

In one embodiment, the energy needed for the electrochemical cells and apparatus of this invention such as for electrolysis, heating, cooling, pumping, pressurized pumps, gas filtering systems or any combination thereof is provided by renewable energy sources such as solar, wind, thermal wave, geothermal or any combination thereof or by conventional energy sources such as coal, oil, gas, power plants or any combination thereof.

In some embodiments, the methods, electrochemical cells and apparatus of this invention may be conducted and/or be used over a course of weeks, or in some embodiments months or in some embodiments years.

In one embodiment, the electrochemical cells and/or apparatus of the invention may comprise multiple inlets for introduction of carbon dioxide, hydrogen and/or air. In some embodiments, the electrochemical cells and/or apparatus will comprise a series of channels for the conveyance of the respective carbon monoxide, hydrogen and other materials, to the reaction chamber or to the gas accumulator. In some embodiments, such channels will be so constructed so as to promote contact between the introduced materials, should this be a desired application. In some embodiments, the electrochemical cells and/or apparatus will comprise micro- or nano-fluidic pumps to facilitate conveyance and/or contacting of the materials for introduction into the reaction chamber.

In another embodiment the electrochemical cells and/or apparatus of this invention may comprise a stirrer in the reaction chamber, for example, in the second reaction chamber. In another embodiment, the electrochemical cells and/or apparatus may be fitted to an apparatus which mechanically mixes the materials, for example, via sonication, in one embodiment, or via application of magnetic fields in multiple orientations, which in some embodiments, causes the movement and subsequent mixing of the magnetic particles. It will be understood by the skilled artisan that the electrochemical cells and/or apparatus of this invention are, in some embodiments, designed modularly to accommodate a variety of mixing machinery or implements and are to be considered as part of this invention.

In one embodiment, the electrochemical cells and apparatus of this invention comprise a tuyere. In another embodiment, a gas comprising carbon dioxide is injected to the molten carbonate via the tuyere. In another embodiment, the tuyere for the gas comprising carbon dioxide is positioned vertically to the reaction chamber. In another embodiment, the tuyere for said gas comprising carbon dioxide is positioned at an angle of between 0.1-45 degree of vertical line of said reaction chamber. In another embodiment, the tuyere for said gas comprising carbon dioxide is positioned at an angle of between 45-90 degree of vertical line of said reaction chamber. In another embodiment, the tuyere for said gas comprising carbon dioxide is positioned at an angle of between 45-90 degree of vertical line of said reaction chamber.

In another embodiment, the tuyere for the gas comprising carbon dioxide has a working diameter of nozzle of between 5-50 mm. In another embodiment, the tuyere for the gas comprising carbon dioxide has a working diameter of nozzle of between 5-15 mm. In another embodiment, the tuyere for the gas comprising carbon dioxide has a working diameter of nozzle of between 10-35 mm. In another embodiment, the tuyere for the gas comprising carbon dioxide has a working diameter of nozzle of between 30-45 mm.

In another embodiment, the nozzle of the tuyere is positioned at a distance of between 15-40 times higher than the working diameter of the tuyere from the bottom of the reaction chamber. In another embodiment, the nozzle of the tuyere is positioned at a distance of between 10-40 times higher than the working diameter of the tuyere from the bottom of the reaction chamber. In another embodiment, the nozzle of the tuyere is positioned at a distance of between 10-30 times higher than the working diameter of the tuyere from the bottom of the reaction chamber.

The term "tuyere" refers to a channel, a tube, a pipe or or other opening through which gas is blown into a furnace wherein the gas is injected under pressure from bellows or a blast engine or other devices.

The term "the bottom of the reaction chamber" refers to the lowest point or lowest surface of the reaction chamber.

In one embodiment, the tuyere is manufactures from titanium. In another embodiment, the tuyere is manufactured from an alloy comprising titanium. In another embodiment the alloy comprises titanium, aluminium, zirconium, tantalum, niobium or any combination thereof.

In one embodiment the carbon monoxide is conveyed directly to the second reaction chamber, such that it does not come into contact with $CO_2$, air or water, prior to entry within the chamber. In one embodiment, such conveyance is via the presence of multiple separate chambers or channels within the apparatus, conveying individual materials to the chamber. In another embodiment, the chambers/channels are so constructed so as to allow for mixing of the components at a desired time and circumstance.

In one embodiment, the electrochemical cells and apparatus of this invention comprise an outlet from one cell and is used as an input for the next cell.

In one embodiment, the electrochemical cells and apparatus of this invention may further include additional means to apply environmental controls, such as temperature and/or pressure. In one embodiment, the electrochemical cells, and/or apparatus of the invention, excluding the electrochemical cell comprising the heating system may include a magnetic field source and mixer to permit magnetically-controlled fluidizing. In another embodiment, the electrochemical cells and/or apparatus may include a mechanical stirrer, a heating, a light, a microwave, an ultraviolet and/or an ultrasonic source. In one embodiment, the device of the invention may include gas bubbling.

In one embodiment, this invention provides a method and an apparatus for the preparation of methanol. The two major processes for methanol production use either high-pressure or low-pressure technology. Each process uses pressurized synthesis gas-a mixture of carbon monoxide, carbon dioxide, and hydrogen. In the high-pressure process, the reaction of the components occurs at pressures of about 300 atm. In the low-pressure process, the reaction is catalyzed with a highly selective copper-based compound at pressures of only 50-100 atm.

In one embodiment, carbon monoxide which is produced in the first electrochemical cell by electrolysis of molten carbonate undergoes a water gas shift reaction to form $CO_2$ and $H_2$, and the $CO_2$ then reacts with hydrogen to produce methanol. In another embodiment, $CO_2$ and $H_2$ react in the presence of a catalyst to yield methanol. In another embodiment the catalyst comprises zinc, copper or their oxides. In another embodiment the hydrogen is produced from fossil fuel based syn-gas or by electrolysis of water. In another embodiment, the present invention provides an apparatus comprising two electrochemical cells, wherein the first electrochemical cell electrolyses molten carbonates to form carbon monoxide and the second electrochemical cell electrolyses water to form hydrogen ($H_2$).

Methods for the electrolysis of water are known. One representative electrolytic cell configuration for electrolysis of water would comprise an anode (+) and cathode (−) separated by a physical barrier, e.g., porous diaphragm comprised of asbestos, microporous separator of polytetrafluoroethylene (PTFE), and the like. An aqueous electrolyte containing a small amount of ionically conducting acid or base fills the anode and cathode compartments of the cell. With application of a voltage across the electrodes hydrogen gas is formed at the cathode and oxygen is generated at the anode.

Electrodes for the electrolysis of water are well known in the art. Such electrodes as well as processes for their production evolved from the technology developed for fuel cells. Such cells are described, for example by Carl Berger, Handbook of Fuel Cell Technology, pages 401-406, Prentice Hall 1968 and H. A. Liebafsky and E. J. Cairns, Fuel Cells and Fuel Batteries, pages 289-294, John E. Wiley and Sons, 1968.

The Fischer-Tropsch process involves a variety of competing chemical reactions, which lead to a series of desirable products. The most important reactions are those resulting in the formation of alkanes. These can be described by chemical equations of the form:

$$(2n+1)H_2+nCO \rightarrow C_nH_{(2n+2)}+nH_2O$$

where 'n' is a positive integer. The simplest of these (n=1), results in formation of methane, which is generally considered an unwanted byproduct (particularly when methane is the primary feedstock used to produce the synthesis gas). Process conditions and catalyst composition are usually chosen, so as to favor higher order reactions (n>1) and thus minimize methane formation. Most of the alkanes produced tend to be straight-chained, although some branched alkanes are also formed. In addition to alkane formation, competing reactions result in the formation of alkenes, as well as alcohols and other oxygenated hydrocarbons. In another embodiment, catalysts favoring some of these products have been developed.

Generally, the Fischer-Tropsch process is operated in the temperature range of 150-300° C. (302-572° F.). Higher temperatures lead to faster reactions and higher conversion rates, but also tend to favor methane production. As a result the temperature is usually maintained at the low to middle part of the range. Increasing the pressure leads to higher conversion rates and also favors formation of long-chained alkanes both of which are desirable. Typical pressures are in the range of one to several tens of atmospheres. Chemically, even higher pressures would be favorable, but the benefits may not justify the additional costs of high-pressure equipment.

A variety of synthesis gas compositions can be used. For cobalt-based catalysts the optimal $H_2$:CO ratio is around 1.8-2.1. Iron-based catalysts promote the water-gas-shift reaction and thus can tolerate significantly lower ratios.

It is to be understood that numerous embodiments have been described herein regarding the methods, electrochemical cells and apparatus whereby the preparation of carbon monoxide and further the preparation of methanol or hydrocarbons may be accomplished, and that any embodiment as such represents part of this invention, as well as multiple combinations of any embodiment as described herein, including combinations of electrodes, alkali carbonate salts, electrochemical cells, in any conceivable combination and via their use in any method or embodiment thereof, as described herein, and as will be appreciated by one skilled in the art.

The following examples are presented in order to more fully illustrate the preferred embodiments of the invention. They should in no way be construed, however, as limiting the broad scope of the invention.

EXAMPLES

Example 1

Electrolysis of Molten $Li_2CO_3$

Methods and Materials:

An electrochemical cell including a titanium cathode, pressed carbon anode and molten $Li_2CO_3$ electrolyte was prepared. A Pt wire as a pseudo-reference electrode was used. Electrode polarization with respect to the open circuit potential was measured. The open circuit potential appeared to be highly reproducible for both Ti-cathode and carbon-anode.

Results:

Cathode Reactions.

Using linear sweep voltammetry and analyzing of the gases produced, it was found that within the temperature range of 800° C.-900° C., production of CO was the only reaction at low current densities (<1.5 A/cm$^2$). At 900° C. and the quasi-static conditions, production of CO became sufficient for practical applications (100 mA/cm$^2$) at the potential shift of −215 mV with respect to open circuit potential (−0.9 V vs Pt) (FIG. 1A). However, at 850° C., the current density of 100 mA/cm$^2$ required potential shift of −320 mV with respect to open circuit potential (−1.1. V vs Pt) (FIG. 1A).

Deposition of the elementary carbon on Ti electrode requires potential shift of >−3 Vat 900° C., at 850° C. this value decreases to ≈−2 V and to <−1.5 Vat 800° C. Thus, the potential window, within which CO is the only product of cathode reaction is large enough for continuous operation of the cell but it rapidly decreases with decreasing temperature. Reduction of Li ion was not observed as long as the cathode was not contaminated by carbon.

Anode Reactions.

Figure 1B:
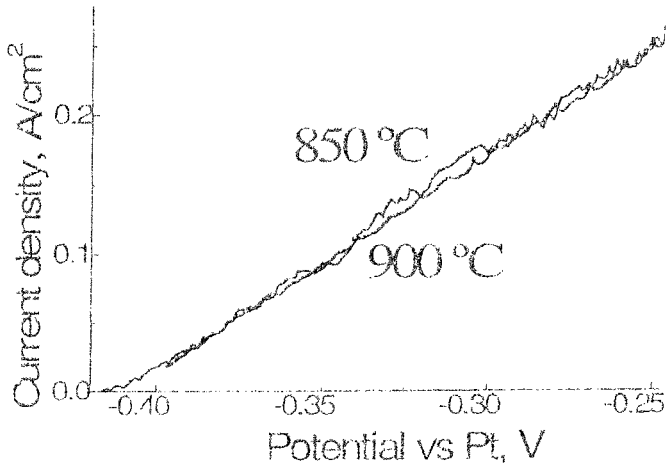
FIG. 1B depicts Quasi-static current-potential dependence for pressed graphite anode in molten $Li_2CO_3$. Linear potential-current dependence indicates that the current is limited by Ohmic resistance.
Figure 2A:
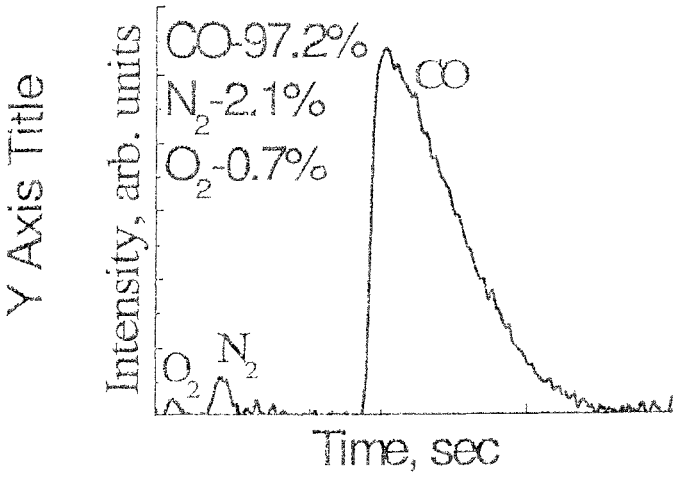
FIG. 2A depicts Chromatogram of the gases in the cathode compartment during the electrolysis at 900° C.; Presence of small fraction of oxygen and nitrogen is due to the small air residue in the compartment.
Figure 2B:
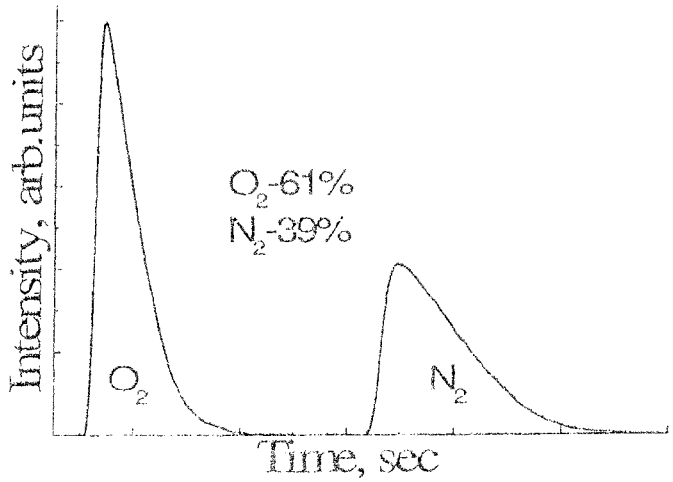
FIG. 2B depicts chromatogram of the gases from the anode compartment three minutes after beginning of the electrolysis at 900° C. After a while the concentration of oxygen approaches 100%. Note: $CO_2$ was not detected in either compartment.

It was found that the only product of the anode reaction is oxygen with no traces of $CO_2$ at any conditions within the temperature range of 800-900° C. (FIG. 2B). However, the current-potential dependence of the graphite anode indicated that the current was restricted by the Ohmic losses (FIG. 1B) and the current density of 100 mA/cm$^2$ could be achieved if the potential shifted by 50 mV from the open circuit voltage. Since, the observed Ohmic resistance did not depend on temperature; it is unlikely that it was related to the resistance of the electrolyte.

Thermodynamic Efficiency:

The Gibbs energy of combustion of CO ($CO+\frac{1}{2}O_2 \leftrightarrow CO_2$) at 900° C. is $\Delta G=181$ kJ/mol, which corresponds to a decomposition potential of 0.94 V. The current density of 100 mA/cm$^2$ on both anode and cathode required application of 1.1±0.05 V. The uncertainty of ±50 mV stems from the difficulty to subtract the voltage drop of the nichrome wires (2 mm diameter) leading to the electrodes. The operation voltage of 1.1±0.05 V corresponds to the thermodynamic efficiency of 85±4%. Relatively high thermodynamic efficiency combined with high current density implies that a practical electrochemical system may be very compact. Furthermore, one can expect that the efficiency can be further increased if the system operates at lower current density and Ohmic losses in the electrodes are minimized.

Example 2

Stability of $Li_2CO_3$ as an Electrolyte $Li_2CO_3$ (99.5%) was first heated up to 450° C. for two hrs to cause complete loss of water. Then it was cooled down to determine the weight. The crucible was heated up to 900° C. for two hours. After cooling the crucible down to room temperature, the weight loss was determined again. Then crucible was heated to 900° C. for 24 hours. It was found that the weight loss after the heating for 2 hrs at 900° C. was 1.2% (w/w) and it did not increase after heating for 24 hrs at 900° C. This result indicates that the equilibrium between the melt and air was achieved. The weight loss of 1.2% (w/w) corresponds to the equilibrium concentration of $Li_2O \approx 0.02$ mol %. Thus in air at 900° C., the reaction $$Li_2CO_3 \leftrightarrow Li_2O+CO_2$$

is strongly shifted towards $Li_2CO_3$. It melts at ≈735° C. and is sufficiently conductive above 800° C.

Example 3

Stability of the Titanium and Graphite Electrodes

Electrolysis of $Li_2CO_3$ at 900° C., for 100 hours at constant potential with the current density of 100 mA/cm$^2$ and 250 mA/cm$^2$ was performed. No noticeable changes in the current density and gas production were observed. After the electrolysis, the electrodes were analyzed by XRD, which revealed formation of a $Li_2TiO_3$ protective layer on the Ti cathode and no changes were detected on the C anode. The Faradaic efficiency determined by direct measurements of the gas production rate was 100%.

After prolonged exposure (100 hrs) of the Ti-built setup to the electrolyte, the concentration of Ti in the electrolyte was below 0.02 mole % (traces) and did not rise upon further exposure. This indicates that this is a solubility limit of Ti in the $Li_2CO_3$ melt.

Pressed chemically pure graphite did not corrode in the molten $Li_2CO_3$ even when it served as an anode. No weight loss to the graphite electrode was detected after 100 hrs of electrolysis (100 mA/cm$^2$ at 900° C.) and exposure to the electrolyte without current.

Example 4

Process of Carbon Cover Preparation on Titanium Electrode

Titanium electrode aged preliminarily under negative potential (3-5 volts) at 900 deg C. dipped into the carbonate melt. Duration of aging was equal 20 min. During the aging titanium electrode coated with carbon cover in compliance with reaction:

$$CO_3^{2-}+4e^- \rightarrow C+3O^{2-}.$$

Deposition of the elementary carbon on Ti electrode requires negative potential shift of >−3 V at 900° C.

After aging under negative potential titanium electrode started working under positive potential as anode. Carbon cover helped the electrode work more correctly and reliably.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An electrochemical cell for the manufacture of CO comprising:

at least two electrodes, wherein a first electrode comprises titanium and a second electrode comprises graphite, titanium or combination thereof; and;

a separating membrane located between the first and second electrodes, the membrane comprising a metal plate attached to two metal grids, the metal grids having pores configured for allowing passage through the membrane of ions involved in the electrolysis and preventing passage of bubbles of oxygen and CO gases, such that border zones are formed between the metal grids of the membrane and the first and second electrodes respectively, preventing mixture of gases originating outside the metal grids; the membrane being made of titanium or titanium alloy.

2. The electrochemical cell of claim 1, comprising:

a. a power supply;

b. a first reaction chamber comprising an alkali metal carbonate salt or a mixture of alkali metal carbonate and alkaline-earth metal carbonates;

d. a heating system; and e. a first conduit which conveys CO from said electrochemical cell to a gas accumulator;

wherein said heating system heats said metal carbonate salt to form molten carbonate said at least two electrodes are in contact with said molten carbonate; and by applying voltage, CO is formed and conveyed via said first conduit to a gas accumulator.

3. The electrochemical cell of claim 1, comprising a tuyere for injecting a gas comprising $CO_2$ to said molten carbonate.

4. The electrochemical cell of claim 1, wherein said at least two electrodes are located in separated compartments.

5. The electrochemical cell of claim 1, wherein said first electrode and second electrode are located in the same compartment.

6. The electrochemical cell of claim 1, wherein said separating membrane is dipped in said molten carbonate.

7. The electrochemical cell of claim 1, wherein said pores have a diameter of between about 0.5 mm to 5.0 mm.

8. The electrochemical cell of claim 1, wherein said two metal grids are connected at an angle alpha ($\alpha$).

9. The electrochemical cell of claim 8, wherein said angle alpha ($\alpha$) is zero degree or said angle alpha ($\alpha$) is between 0.1 to 45 degrees.

10. The electrochemical cell of claim 2, wherein said alkali metal carbonate salt comprises lithium carbonate, sodium carbonate, potassium carbonate or any combination thereof.

11. The electrochemical cell of claim 2, wherein said alkali metal carbonate comprises at least 50% by weight of lithium carbonate.

12. The electrochemical cell of claim 2, wherein said alkaline-earth metal carbonate salt is barium carbonate, strontium carbonate, calcium carbonate or any combination thereof.

13. The electrochemical cell of claim 2, wherein said mixture of alkaline and alkaline-earth carbonates is in a ratio of between 1:1 molar ratio to 0.95:0.05 molar ratio respectively.

14. The electrochemical cell of claim 1, wherein said first electrode is a cathode and wherein said cathode is a titanium or a titanium alloy electrode, wherein said alloy comprises titanium, aluminium, zirconium, tantalum, niobium or any combination thereof.

15. The electrochemical cell of claim 1, wherein said second electrode is an anode and said anode is a graphite, a pressed graphite or a glassy graphite electrode.

16. The electrochemical cell of claim 1, wherein said second electrode is an anode and said anode is a titanium electrode coated by graphite.

17. The electrochemical cell of claim 1, wherein said second electrode is an anode and said anode is a titanium or a titanium alloy electrode, wherein said alloy comprises titanium, aluminium, zirconium, tantalum, niobium or any combination thereof.

* * * * *